US005487239A

United States Patent [19]

Jenkins et al.

[11] Patent Number: 5,487,239

[45] Date of Patent: Jan. 30, 1996

[54] REFRIGERATOR GASKET ASSEMBLY

[75] Inventors: Thomas E. Jenkins; Charles R. Mulligan; Duane Jubenville, all of Louisville, Ky.

[73] Assignee: General Electric Company, Louisville, Ky.

[21] Appl. No.: 254,396

[22] Filed: Jun. 6, 1994

[51] Int. Cl.[6] ..... E06B 7/22

[52] U.S. Cl. ..... 49/498.1; 312/405

[58] Field of Search ..... 49/498.1, 478.1; 312/405, 400

[56] References Cited

U.S. PATENT DOCUMENTS

| | | | |
|---|---|---|---|
| 3,001,251 | 9/1961 | Johnson | 49/498.1 |
| 3,178,778 | 4/1965 | Reahard | 49/498.1 |
| 4,970,102 | 11/1990 | Guillon | 49/498.1 |

*Primary Examiner*—James R. Brittain

*Assistant Examiner*—Gerald A. Anderson

*Attorney, Agent, or Firm*—H. Neil Houser

[57] ABSTRACT

A refrigerator has a cabinet with an outer case and an inner liner. The liner forms a storage compartment with an access opening. A cabinet face portion surrounds the opening and a door selectively closes the compartment. The door includes a flange which overlaps the face portion and a gasket mounted on the flange engages face portion. The gasket is an elongated body of a co-extruded material and includes a base wall of a rigid material mounted on the door frame, a contact wall spaced from the base wall for sealing engagement with the face portion and a pair of side walls connecting the base and contact walls to form a hollow interior. The contact wall includes a pair of spaced apart elongated strips of more rigid material connected by an elongated strip of less rigid material. The less rigid strip has an elongated outward projecting bow shape. The side walls are indented in a "V" shape and the apex of the V has a reduced thickness. A strip of fiber glass, with a net like backing on one side, is in the interior of the gasket.

19 Claims, 3 Drawing Sheets

REFRIGERATOR GASKET ASSEMBLY

BACKGROUND OF THE INVENTION

For a number of years the doors of refrigerators have been held closed by cooperating strips of magnetic material. This required that the face portion of the cabinet surrounding each of the storage compartments include a substantial strip of magnetic material, normally a portion of the steel outer case. Also the gaskets normally included extensive strips of magnet material which were attracted to the steel outer case face portion to hold the door closed and pull the gasket to the steel outer case to form a good seal. Such constructions do not provide optimum heat sealing of the compartment, even though they employ relatively high sealing pressures. For example, the metal in the cabinet face portion and door flange, as well as the magnet, increase the heat conduction.

With the increased need to reduce the energy consumption of refrigerators, it is desirable to reduce the heat transfer through the door seal area. One approach has been to modify the cabinet and door construction so that there is less metal in the cabinet face portion. This leads to the need to substantially reduce or eliminate the magnets as the means of holding the door closed; which results in a much lower force being available to urge the door to its closed position.

With such low force constructions there is a need for the gasket to be soft and easily compressible to assure a good seal. At the same time the gasket must return to substantially its original shape despite many door opening and closing operations and despite the fact that during the life of the refrigerator the door will be closed, with the gasket compressed, most of the time.

At least most plastic materials from which it is reasonable to extrude flexible gaskets have fairly high coefficients of friction with the cabinet face portion. As a refrigerator door opens and closes, the contact wall of the gasket slides across the cabinet face portion. When the gasket contact wall/cabinet face portion have a fairly high coefficient of friction, the gasket contact wall will adhere to or "scrub" against the cabinet, resulting in poor seals and shortened gasket life.

It is therefore an object of this invention to provide an improved refrigerator gasket assembly.

It is another object of this invention to provide such an improved gasket assembly which requires only a small force to compress the gasket for a good seal.

It is yet another object of this invention to provide such an improved gasket assembly which has long life.

SUMMARY OF THE INVENTION

In accordance with one form of the invention a refrigerator comprises a cabinet with an outer case and an inner liner. A storage compartment formed by the liner has an access opening surrounded by a cabinet face portion. A door is hinged to the case along one edge for selective closing of the access opening. The door has a flange which overlies the cabinet face portion when the door is in its closed position. An elongated gasket is mounted to the door flange to seal against the cabinet face portion when the door is closed. The gasket comprises an elongated body of co-extruded plastic material including an elongated base wall of relatively rigid material mounted on the door flange, a contact wall overlying and spaced from the base wall for sealing engagement with the face portion and a pair of spaced apart, flexible side walls joining the base and contact walls and forming therewith a hollow gasket interior containing a compressible material. The contact wall comprises alternate longitudinally extending strips of more rigid and less rigid material.

DETAILED DESCRIPTION OF PREFERRED EMBODIMENT

Figure 1:
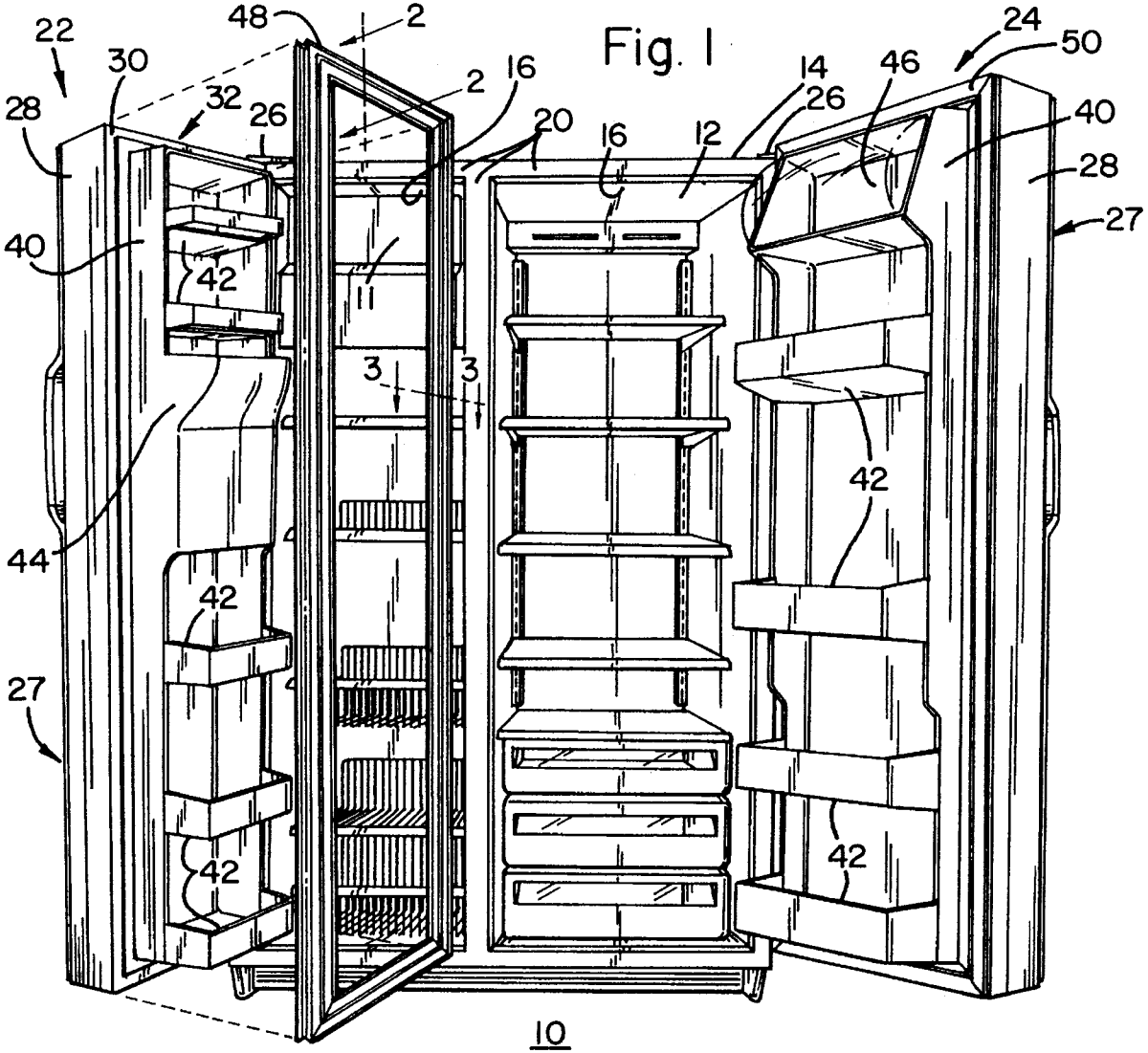
FIG. 1 is a simplified perspective view of a refrigerator with the access doors open and with one gasket removed for purposes of illustration.

In FIG. 1 there is illustrated a household refrigerator 10 of the side-by-side type; that is a freezer storage compartment 11 and a fresh food storage compartment 12 are arranged side-by-side within the refrigerator. The refrigerator 10 has a cabinet including an outer case 14 and an inner liner 16, with the space between them filled with foamed-in-place insulation 18 (See FIG.'s 5 and 7). The outer case normally is formed by folding a sheet of a suitable material such as painted steel and the inner liner 16 is molded of a suitable plastic material or is formed from a sheet of metal to define the freezer compartment 11 and the fresh food compartment 12. The liner may be formed as a single shell defining both compartments or as two separate shells, in which case a mullion will be placed between them. In either event the liner can be considered as a single element. The front of the cabinet includes a face portion 20 which surrounds the front access openings of the freezer and fresh food compartments. Conveniently, the outer case has an inward projecting front peripheral flange and a breaker strip bridges the gap between the flange and the front edge of the liner. The breaker strip normally is molded of a suitable plastic material such as, for example, an acrylo-butadiene-styrene (commonly referred to as ABS) material, a styrenic material or an olefin material. The face portion normally is formed by the parts of the outer case flange and the breaker strip which face the front of the refrigerator. In the low force constructions referred to above the door mounted gasket normally engages the part of the face portion formed by the plastic breaker strip.

A freezer door 22 and a fresh food door 24 close the access openings to the freezer and the fresh food compartments respectively. Each is mounted by top hinges 26 and bottom hinges, not shown, to rotate about its outer edge between an open position, shown in FIG. 1, and a closed position closing the associated storage compartment. Conveniently both doors are made with the same basic construction, and it will be understood that the following description of freezer door 22 also applies to fresh food door 24.

Viewing FIG.'s 1 and 3, door 22 includes an outer door panel 27, normally formed by a folded sheet of painted steel, which has a front, not shown, and a generally perpendicular lateral wall 28 forming top. bottom and sides of the door. The lateral wall ends in an inwardly projecting peripheral flange 30, lying in a plane parallel to and spaced from the door front. An inner door panel 32, normally molded from a suitable plastic material, includes a peripheral flange 34 which overlies the outer door panel flange 30. The inner panel 32 is mounted on and supported by the outer panel 27 by means of a connection strip 36 which overlies the outer edge of the inner panel flange 34 and is secured to the outer panel flange 30 by screws 38. Within the flange 34 the inner panel is formed with a wall 40 projecting away from the outer panel to be received in the storage compartment when the door is closed. The wall 40 supports removable shelves 42 for items to be stored. In addition, the inner panel can be formed with integral features such as an ice dispenser 44 (door 22) or a butter and cheese keeper 46 (door 24). Conveniently the space between the inner and outer door panels also is filled with insulation.

Figure 3:
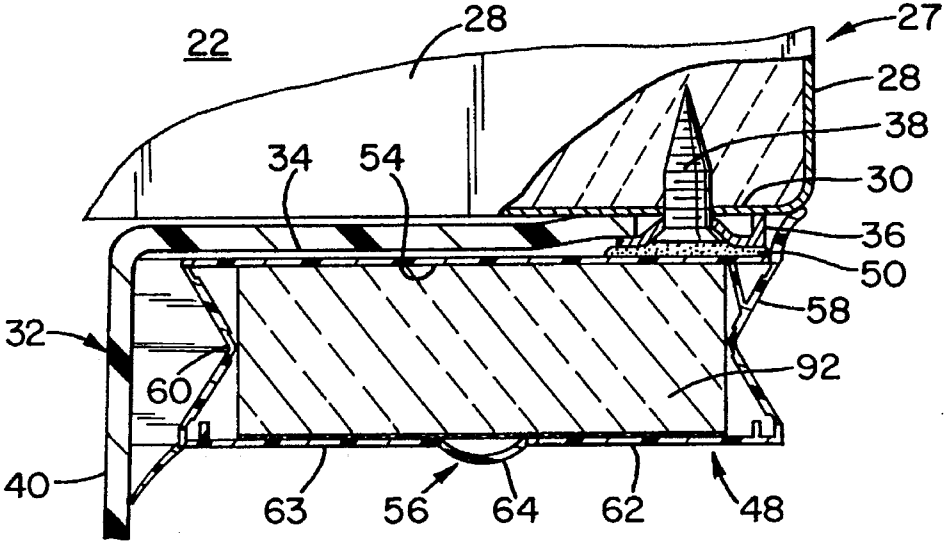
FIG. 3 is a cross-section view of the freezer gasket assembly generally as seen along line 3—3 in FIG. 1, but with the gasket attached to the freezer access door.

A gasket 48 extends around the periphery of the freezer door 22 and engages the cabinet face portion 20 surrounding the freezer 11 when door 22 is closed. More specifically, gasket 48 overlies the portion of door 22 comprised of outer door panel flange 30, inner door panel flange 34 and connection strip 36. Gasket 48 is mounted to the door by an adhesive 50 which connects it to the strip 36 (see FIG. 3).

A gasket 52 extends around the periphery of the fresh food door 24 and engages the cabinet face portion surrounding the fresh food storage compartment 12 when door 24 is closed. The gasket 52 is wider than the gasket 48. Otherwise the construction is the same. Therefore, it will be understood that the following description of casket 48 also applies to gasket 52. Gasket 48 is made from a length of extruded plastic material having the desired cross section shape. Desired lengths are cut with mitered corners and are joined, as by welding or gluing for example, to form an open rectangle or picture frame configuration. As will be explained in more detail hereafter, the gasket is co-extruded of two or more different plastic materials and/or a material having two or more thicknesses to provide different portions of the gasket with different desired characteristics.

It will be understood that, for the purposes of this invention, a "rigid" plastic material has a Shore D Durometer hardness between about 60 and about 95, and preferably between about 80 and about 90; a "semi-rigid" plastic material has a Shore D Durometer hardness between about 45 and about 70, and preferably between about 50 and about 60; and a "flexible" plastic material has a Shore A Durometer hardness between about 50 and about 90, and preferably between about 70 and about 85.

It is contemplated that the gasket can be co-extruded with a plurality of entirely different compatible plastic materials. However, the exemplification embodiment was co-extruded with a number of somewhat different formulations of polyvinyl chloride (commonly referred to as PVC). Rigid PVC materials have essentially no plasticizer; semi-rigid PVC materials have up to about 10% plasticizer; and flexible PVC materials have between about 10% and about 40% plasticizer. In formulating the materials for the exemplification embodiment, the per cent of plasticizer in the material for each part of the gasket was empirically determined to provide a material hardness the preferred range.

Referring now more particularly to FIG.'s 3 and 4, gasket 48 includes an elongated base wall 54 which is seated against the flange area of the freezer door 22; an elongated contact wall 56 which overlies and is spaced from the base wall 54 to engage the cabinet face portion 20 when the door is closed; and a pair of opposed. spaced apart elongated side walls 58, 60 which connect the base and contact walls 54, 56, to form therewith a hollow gasket interior 57.

Base wall 54 is formed from a suitable relatively rigid plastic material such as semi-rigid or rigid PVC with a Shore D Durometer hardness between about 45 and about 95, and preferably between about 50 and about 90. Typically a semi-rigid/rigid PVC base wall with a thickness between about 0.018 inch and about 0.027 inch will provide the gasket with excellent dimensional stability. That is, the gasket extrusion will be straight, even though the other walls are not as rigid as base wall 54. Also the extrusion can be cut to length with precision to form the top, bottom and side portions of the gasket. In this regard, a length tolerance of plus or minus about 0.075 inch is desirable. Once the gasket is assembled to a door, the base wall substantially prevents the various portions of the gasket from sagging under the influence of gravity. From a structural characteristics standpoint it is preferable to extrude the base wall 54 of a rigid material; however, for ease of manufacture, it may be preferable to extrude base wall 54 of a semi-rigid material to coincide with the material of some other portions of the gasket.

The contact wall 56 has a three section construction with elongated side portions or strips 62, 63 joined by an elongated central portion or strip 64. The central strip 64 has a longitudinally extending outward bow configuration. Preferably the side strips 62, 63 are extruded from semi-rigid or rigid plastic material, such as PVC with a Shore D Durometer hardness between about 45 and about 95 and preferably between about 50 and about 90. The central strip is extruded from a flexible material, such as flexible PVC with a Shore A Durometer hardness between about 50 and about 90 and preferably between about 70 and about 85. As the door closes the contact wall initially slides across the cabinet face portion 20, particularly along the side of the gasket nearest the axis of rotation of the door. If the coefficient of friction between the gasket and the face portion is greater than about 0.3, the gasket will tend bind or scrub on the face portion and a good seal will not be obtained. In fact, the scrubbing action can be so extreme as to prevent the door from fully closing. With the construction of the contact wall 56, the side portion or strip 63 first contacts the face portion 20 and coefficient of between the rigid/semi-rigid PVC and the face portion 20 is less than 0.3. Thus the gasket does not tend to bind or scrub.

Figure 5:
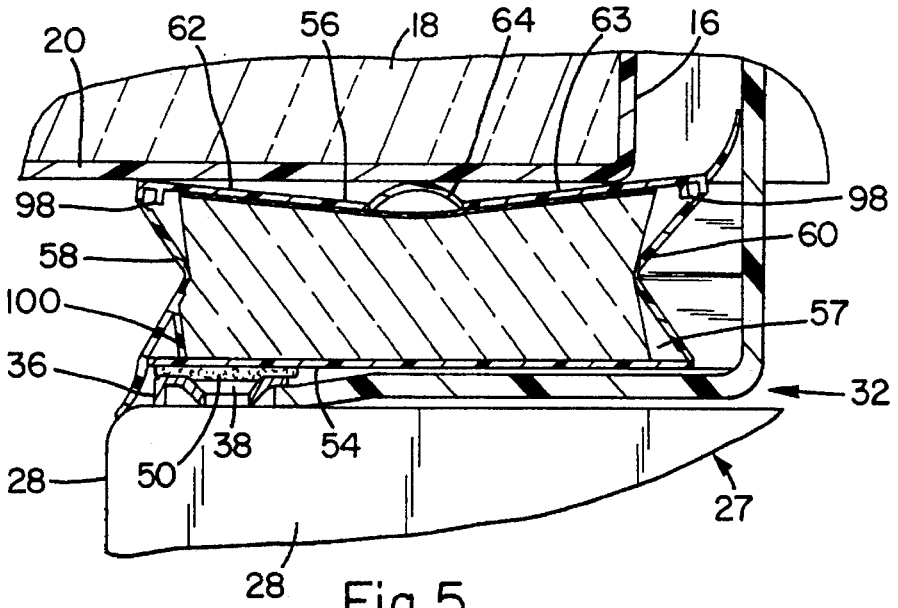
FIG. 5 is a cross section view of the gasket assembly of FIG. 3, but with the door in its closed position.

The elongated outwardly bowed or bubble shaped central strip serves several purposes. First, it imparts a desired greater degree of flexibility to the contact wall. Second, in the event the gasket is not extruded in a perfectly straight configuration or one or more of the corners is not perfectly square, a twisting stress is imparted to the contact face and the flexible bubble strip 64 relieves the twisting stress and improves the planarity of the side portions 62, 63. Third, when the door is fully closed, as shown in FIG. 5 for example, the contact between the contact wall 56 and the face portion is essentially along three parallel lines. That is only the outer edge portion of each side strip 62, 63 and the center of bubble strip 64 are in engagement with the face portion 20 (generally as seen in FIG. 5). This distinct line contact provides a surer seal than is obtained by using the entire surface of contact wall 56.

A gasket which feels soft to the touch impresses many users as having poor sealing characteristics, even though it may seal very well. The contact wall 56, with its stiffer side strips 62, 63 and its more flexible center strip 64, presents a fairly stiff feel to the touch, which imparts a sense of "quality" to the user of the refrigerator.

The side wall 58 is in the form of an elongated, horizontally oriented "V" with its apex 66 inward of the lateral edges of the base and contact walls. The side wall 58 preferably is extruded of a flexible material such as PVC with predetermined thicknesses. The thickness of the side wall 58 is reduced along the apex 66 and along each of its distal edges 68, 69, where the wall 58 joins base wall 54 and contact wall 56, respectively. Thicker sections 70, 71 extend between the reduced thickness sections. The end wall 60 is a mirror image of end wall 58, in the form of a "V" with its apex inward of the adjacent lateral edges of base wall 54 and contact wall 56. The apex 74 and distal edges 76, 77 of wall 60 have a reduced thickness while the intermediate sections 78, 79 are thicker.

The reduced thickness sections 66, 68, 69 and 74, 76, 77 act as hinges so that, when the gasket is compressed, the thicker sections 70, 71 and 78, 79 move toward each other and then separate when the compression force is removed. The thicker sections 70, 71 and 78,79 provide structural strength to the side wall and act as a source of platicizer which slowly migrates to the adjacent hinge sections and helps them maintain their flexibility over time. In the exemplification embodiment the side walls are extruded of a flexible plastic such as PVC with the thicker sections 70, 71 and 78, 79 having a thickness of between about 0.020 inch and about 0.025 inch and with the hinge sections 66, 68, 69 and 74, 76, 77 having a thickness of between about 0.008 inch and about 0.014 inch.

An elongated lip 80 projects outward of the junction between contact wall 56 and end wall 60. When the gasket is mounted on the door, the lip 80 engages the door inner panel wall 40 and provides a smooth seal between the inner panel 32 and the gasket 48. In addition, it provides additional support which helps prevent sideways distortion of the side of the gasket closest to the axis of rotation of the door as the door closes. An elongated flap 82 projects outward from the junction of the base wall 54 and the end wall 58. When the gasket 48 is mounted on the outer door 22, the flap 82 engages the door outer panel at the junction between the lateral wall 28 and the peripheral flange 30 and provides a good seal between the gasket and the outer door panel, preventing exterior moisture migration.

Figure 2:
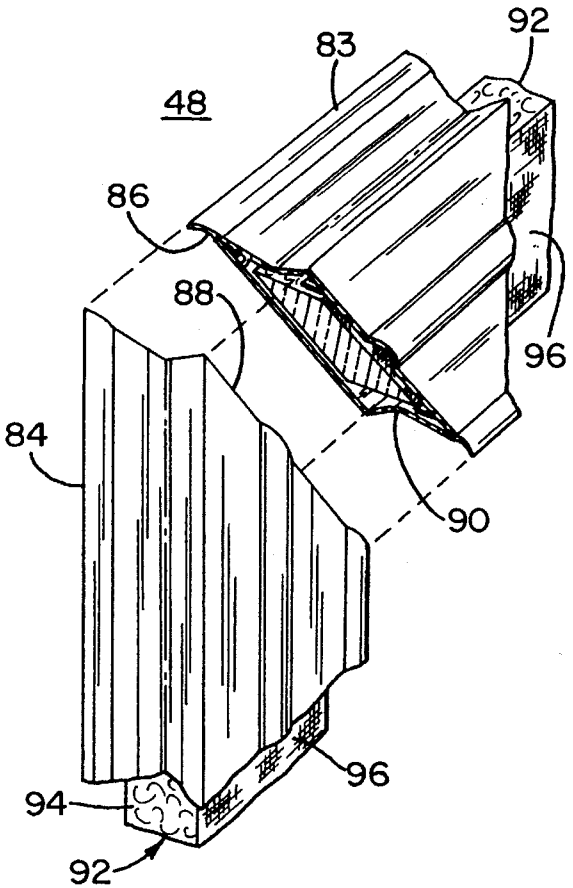
FIG. 2 is an exploded view of a corner portion of the freezer door gasket generally as seen along line 2—2 in FIG. 1.

In order to form an open rectangle or picture frame gasket, such as 48 or 50, the extruded length of gasket material is cut into individual pieces with lengths corresponding to the top, bottom and sides of the gasket. Referring now to FIG. 2, there is shown the top left corner (as viewed in FIG. 1) of the gasket 48. The mating corners of the top gasket piece 83 and side gasket piece 84 are formed with appropriate miters 86, 88 and the pieces are joined by welding or other suitable means to form a right angle corner. All four corners are similarly formed to provide the picture frame gasket. Adjacent each corner of the gasket, the inner side wall of each gasket piece is formed with a cutout, as shown at 90.

Strips of insulation material are cut to coincide in length and shape to each gasket piece. Once the gasket has been welded into its picture frame shape, a strip of insulation material of the proper length and mitered corners is inserted into each gasket piece through the cutouts 90. While a separate strip of insulation is inserted into each gasket piece, the insulation strips meet at the gasket corners and can be considered as one strip. Of course, if desired, a suitable strip of insulation material can be inserted into the extended length of gasket material before it is cut into individual pieces.

The insulation material has low heat conductivity to enhance the insulating capacity of the gasket. In addition, it acts as a spring. That is, when the door is closed, the insulation material is compressed and then, when the door is subsequently opened, the insulation springs back and aids in returning the gasket to its original configuration. With a low closing force system it is desirable that only a very low compression force be needed to compress the insulation; such as, for example, between about 0.015 pound per square inch and about 0.025 pound per square inch will compress the insulation about 30%. It also is desirable that the gasket, including the insulation material, have a low spring rate such that, for example, a compression force between about 0.06 and about 0.90 pounds per square inch will compress the gasket about 30%.

In the exemplification embodiment the insulation is formed of a strip 94 of fiber glass having a low density on the order of 0.5 pounds per cubic foot. A net like open mesh backing or cover 96 of suitable material, such as a synthetic fiber like polyester, is adhered to at least one side of the fiber glass strip, preferably adjacent either the gasket base wall or contact wall. The backing provides axial strength to the insulation strip 92 so that it can be pulled through the gasket. If it is desired to provide greater stability and strength to the insulation strip 94, backing can be adhered to two opposite sides of the strip, preferably adjacent both the base and contact walls of the gasket. In the exemplification embodiment the strip 92 of insulation material is generally rectangular in cross section, with a thickness sufficient to extend substantially completely between base wall 54 and contact wall 56 and with a width sufficient to extend substantially completely between apex 66 of side wall 58 and apex 74 of side wall 60.

Figure 4:
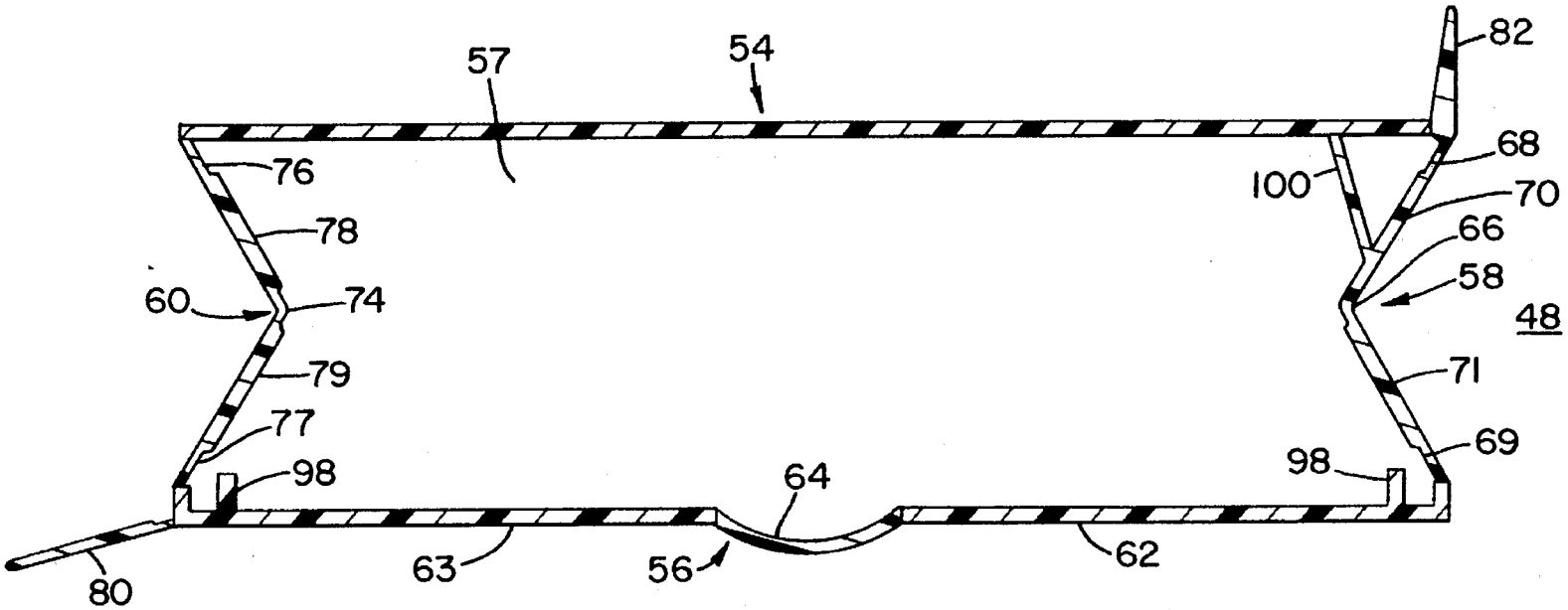
FIG. 4 is an enlarged cross section view of the freezer door gasket of FIG. 1, with the insulation material removed.

Under some extreme conditions, such as when the ambient temperature is above about 90 degrees F., the outer edges of the gasket contact wall 56 may need to be even stiffer. Referring now to FIG. 4, a small elongated rib 98 extends perpendicularly to each of the contact wall side portions 62, 63 into the interior of the gasket. These ribs provide the additional desired stiffness. Under some extreme conditions, such as when the ambient temperature is above about 90 degrees F., the side wall 58 may tend to fold outward when the gasket is compressed. An elongated gusset 100 connected between thicker side wall section 70 and base wall 54 will assure that the side wall folds inward, even under extreme conditions.

Figure 6:
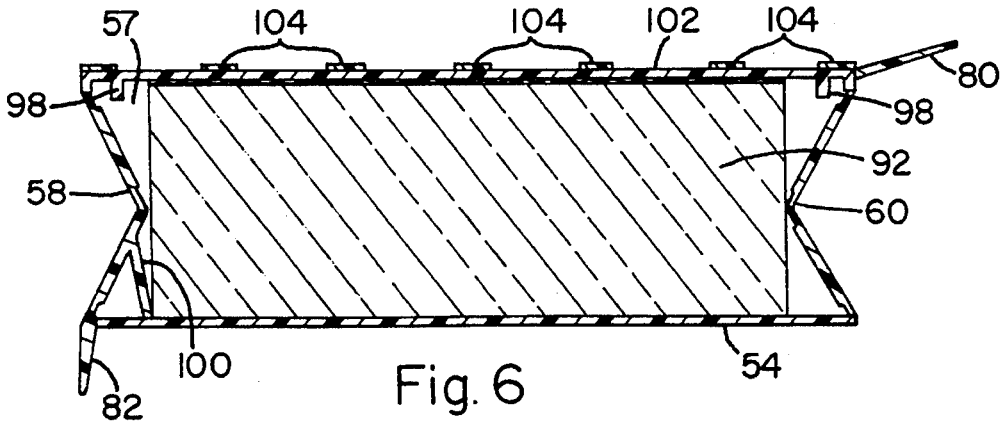
FIG. 6 is a cross section view similar to FIG. 4, but illustrating an alternative gasket configuration.

Referring now to FIG. 6, there is illustrated a gasket incorporating another embodiment of the present invention. Except for the contact wall, the gasket of FIG. 6 is the same as that shown in FIG.'s 1–5 and like numerals have been used for like parts. The contact wall 102 is extruded from a continuous width of a thick, flexible material, such as flexible PVC. Such material has a high coefficient of friction with the cabinet face portion 20 and would "scrub" on the face portion. To prevent such scrubbing, a series of elongated, laterally spaced apart strips 104 of a more rigid material are extruded along the outside surface of the wall 102. The strips 104 engage the cabinet face portion and do not scrub. The contact wall 102 does not tend to twist if welded slightly off square or not extruded perfectly straight. In addition, the corner welds are very strong and have a better appearance than the gasket of FIG.'S 1–5. In the exemplification embodiment the wall 102 is an extrusion of flexible PVC about 0.06 inch thick with a Shore A Durometer hardness of about 70; and the strips 104 are extruded of rigid/semi-rigid PVC about 0.01 inch thick, with a coefficient of friction with the cabinet face portion between about 0.1 and about 0.3 and with a Shore D Durometer hardness of about 70.

Figure 7:
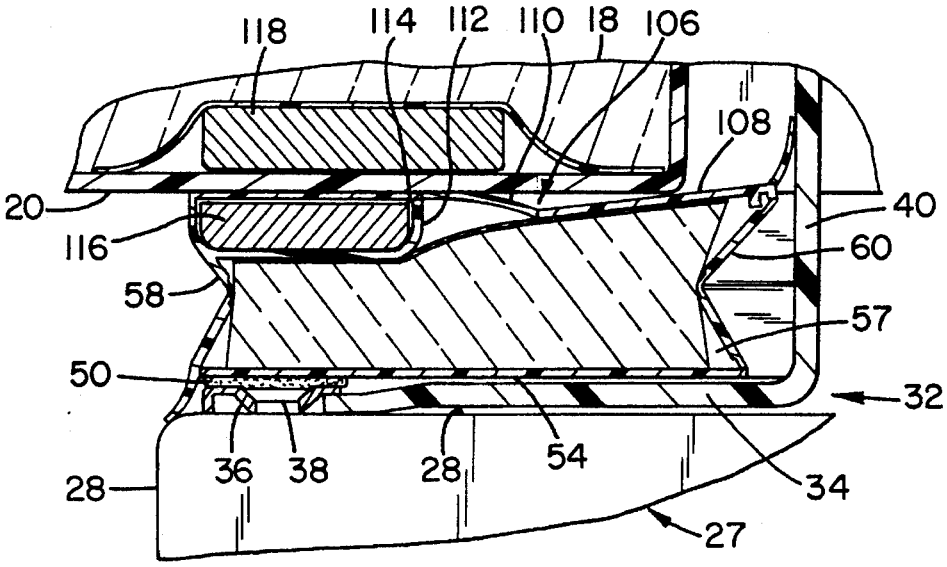
FIG. 7 is a cross section view similar to FIG. 5, but illustrating another alternative gasket configuration.

Many of the features and advantages of the present invention can be incorporated into gaskets utilizing long magnet members to obtain high door closing forces. FIG. 7 illustrates such a construction in which the gasket is basically the same as previously described, except for the contact wall and the magnet material, and like numbers have been used to identify like parts. The contact wall 106 includes a right hand strip (as seen in FIG. 7) which is a relatively thick extrusion of semi-rigid or rigid PVC and a left hand strip 110 which is relatively thin extrusion of flexible PVC. The left hand portion of wall 106 also includes a backing sheet 112 which, together with strip 110 and a part of side wall 58, forms an elongated pocket 114. Magnetic material, such as a flexible strip magnet 116, is positioned within the pocket 114. A strip 118 of magnetic material, such as steel of a strip magnet, extends along the inside of the cabinet face portion 20 in alignment with the strip magnet 116. The strips 116, 118 attract each other and provide the desired closing force. The embodiment of FIG. 7 assumes that face portion 20 is formed by a non-ferrous breaker strip. If the face portion is formed at least in part by the ferrous outer case, then the magnetic strip 118 can be omitted as the strip magnet 116 will be attracted to the magnetic outer case.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator comprising:

a cabinet having an outer case and an inner liner, a storage compartment formed by said liner and having an access opening surrounded by a cabinet face portion;

a door hingedly mounted along one of its edges for selectively closing said access opening, said door including a peripheral flange;

an elongated gasket mounted on said door peripheral flange for sealing engagement with said cabinet face portion when said door closes said access opening;

said gasket comprising an elongated body of co-extruded material including an elongated base wall mounted along said door flange, a contact wall overlying and spaced from said base wall for sealing engagement with said cabinet face portion, and a pair of spaced apart flexible side walls joining said base and contact walls and forming therewith a hollow interior containing compressible insulation material; and said contact wall comprising a pair of longitudinally extending strips of more rigid material connected by an longitudinally extending strip of less rigid material; said strip of less rigid material being formed with an elongated bow projecting away said base wall.

2. A refrigerator as set forth in claim 1, wherein: said contact wall is constructed and arranged so that at least one strip of more rigid material first contacts said cabinet face portion as said door moves toward sealing engagement with said face portion.

3. A refrigerator as set forth in claim 2, wherein: said at least one strip of more rigid material has a coefficient of friction with said cabinet face portion of no more than about 0.3.

4. A refrigerator as set forth in claim 1, wherein: said compressible insulation material is so constructed that a force of between about 0.015 pound and about 0.025 pound per square inch will compress the material about 30%.

5. A refrigerator as set forth in claim 1, wherein: said gasket is so constructed that a compression force of between about 0.06 pound and about 0.09 pound per square inch will compress said gasket about 30%.

6. A refrigerator as set forth in claim 1, wherein: said elongated strips of more rigid material are formed of a plastic material having a Shore D Durometer hardness of between about 45 and about 95 and said elongated strip of less rigid material is formed of a plastic material having a Shore A Durometer hardness between about 50 and about 90.

7. A refrigerator as set forth in claim 1, wherein: said elongated strips of more rigid material are formed of a plastic material having a Shore D Durometer hardness of between about 50 and about 90 and said elongated strip of less rigid material is formed of a plastic material having a Shore A Durometer hardness of between about 70 and about 85.

8. A refrigerator as set forth in claim 1, wherein:

said door comprises an outer panel having an inwardly projecting peripheral flange extending thereabout and an inner panel having an outwardly projecting flange extending thereabout and overlapping said outer door panel flange;

said gasket base wall being mounted to said door by adhesive along the area of overlap of said inner and outer door panel flanges.

9. A refrigerator as set forth in claim 8, wherein:

said door comprises an outer panel having a peripheral side wall and a peripheral flange projecting inwardly thereabout;

said door further comprises an inner panel having an outwardly projecting flange extending thereabout and overlapping said outer door panel flange;

said inner door panel also including a wall projecting away from said outer door panel along the inside of said inner door panel flange; and said gasket includes a elongated flap engaging said outer door panel in the area of the junction of its peripheral side wall and peripheral flange and an elongated flexible lip engaging said inner door panel wall.

10. A refrigerator as set forth in claim 1, wherein; said compressible insulation material is formed from an elongated strip of fiber glass having a generally rectangular cross section cross section and with a backing adhered to at least one side thereof.

11. A refrigerator as set forth in claim 1, wherein: each of said side walls is formed with an inwardly projecting offset.

12. A refrigerator comprising:

a cabinet having an outer case and an inner liner, a storage compartment formed by said liner and having an access opening surrounded by a cabinet face portion;

a door hingedly mounted along one of its edges for selectively closing said access opening, said door including a peripheral flange;

an elongated gasket mounted on said door peripheral flange for sealing engagement with said cabinet face portion when said door closes said access opening;

said gasket comprising an elongated body of co-extruded material including an elongated base wall mounted along said door flange, a contact wall overlying and spaced from said base wall for sealing engagement with said cabinet face portion, and a pair of spaced apart flexible side walls joining said base and contact walls and forming therewith a hollow interior containing compressible insulation material;

said contact wall comprising alternate longitudinally extending strips of more rigid material and less rigid material; and each of said side walls is formed with an inwardly projecting offset in the general shape of a V with its apex inward of the junctions of that side wall with said base wall and said contact wall, and each of said side walls has a reduced thickness in the area of said apex of said V.

13. A refrigerator as set forth in claim 12, wherein: each of said side walls has a reduced thickness in the area of its junctions with said base wall and said contact wall.

14. A refrigerator as set forth in claim 12, wherein: a rib extends longitudinally of said contact wall and projects into said gasket adjacent the junctions of said contact wall with said side walls.

15. A refrigerator as set forth in claim 12, further comprising: an elongated gusset joining adjacent portions of said base wall and one of said side walls.

16. A refrigerator as set forth in claim 12, wherein: said contact wall comprises an elongated extrusion of less rigid material with laterally spaced apart elongated strips of more rigid material projecting therefrom away from said base wall.

17. A refrigerator as set forth in claim 16, wherein: said strips of more rigid material have a coefficient of friction with said cabinet face portion of no more than between about 0.1 and about 0.5.

18. A refrigerator as set forth in claim 16, wherein: said extrusion of less rigid material is formed of a plastic material with a Shore A Durometer hardness of no more than about 70 and said strips of more rigid material are formed of a plastic material with a Shore D Durometer hardness of between about 50 and about 90.

19. A refrigerator as set forth in claim 12, wherein: said contact wall comprises a pair of spaced apart elongated strips of more rigid material connected by an elongated strip of less rigid material formed with an elongated bow projecting away from said base wall.

* * * * *